US005122936A

United States Patent [19]

Guthrie

[11] Patent Number: 5,122,936

[45] Date of Patent: Jun. 16, 1992

[54] SWIMMING POOL LIGHTING

[75] Inventor: John H. Guthrie, Melbourne, Australia

[73] Assignee: SPA Electrics Pty. Ltd., Australia

[21] Appl. No.: 699,976

[22] Filed: May 13, 1991

[51] Int. Cl.[5] ..... F21V 33/00

[52] U.S. Cl. ..... 362/101; 362/96; 362/294; 362/373; 362/396

[58] Field of Search ..... 362/96, 101, 154, 267, 362/294, 364, 373, 365, 147, 396

[56] References Cited

U.S. PATENT DOCUMENTS 1,968,072 7/1934 Creighton ..... 362/101

3,339,066 8/1967 Hart ..... 362/267

*Primary Examiner*—Stephen F. Husar

*Attorney, Agent, or Firm*—Merchant, Gould, Smith, Edell, Welter & Schmidt

[57] ABSTRACT

A below water light assembly for mounting on a wall surface of a pool, includes a backing plate which is located adjacent said surface of the pool when the assembly is mounted on said wall, a lens sealingly mounted in relation to said backing plate and defining a water-tight chamber therewith, and an electric light source or lamp mounted within said chamber and connectable to an electric power source by an electric cable extending from said electric light source or lamp through a water-tight seal in said backing plate. An annular housing member extends around and rearwardly from, the periphery of the backing plate. The annular housing member has a plurality of openings formed around its circumference, such that when said light assembly is mounted on said pool surface, water in the pool is able to circulate through a compartment defined by said surface, the housing member and the backing plate.

16 Claims, 3 Drawing Sheets

SWIMMING POOL LIGHTING

This invention relates to an improved below water light assembly for a swimming pool or spa, and to a water extractor system incorporating such light assembly.

In some swimming pools or spas (hereinafter collectively referred to as pools), there is a requirement for circulating water between a body of water in the pool and a filtration and heating installation. A variety of extraction ports at the pool are used for this purpose, and the present invention is directed to providing improvements or alternatives for such port.

The present invention provides a below water light assembly for mounting on a wall surface of a pool, said light assembly including:

a backing plate which is located adjacent said surface of the pool when the assembly is mounted on said surface, a lens sealingly mounted in relation to said backing plate and defining a water-tight chamber therewith, an electric light source or lamp mounted within said chamber and being connectable to an electric power source by an electric cable extending from said electric light source or lamp through a water-tight seal in said backing plate, and an annular housing member extending around, and extending rearwardly and preferably outwardly from, the periphery of said backing plate, said annular housing member having a plurality of openings formed around its circumference, such that when said light assembly is mounted on said pool surface, water in the pool is able to circulate through a compartment defined by the said surface, the housing member and the backing plate.

When mounted on the surface of the pool, a rear peripheral edge of the housing member is adjacent to the pool surface. The housing member and the backing plate therefore define with the surface a compartment which, in the absence of openings in the housing member, would be substantially isolated from the body of water in the pool. Such isolated compartment is typical of many known light assemblies and is found to result in a quantity of stagnant water being trapped behind the light assembly. When the latter is removed for servicing, the stagnant water passes into the body of water, resulting in its discoloration and providing a possible health risk. However, the provision of openings around the housing member of the light assembly enables water circulation between the body of the pool and the compartment behind the light assembly, preventing the stagnation of water behind the assembly.

The openings in the housing member may comprise at least two holes or slots, preferably substantially diametrically opposed, or a larger number of holes or slots. It is preferred that the openings are spaced from respective front and rear edges of the housing member and, hence, each defined by a respective continuous rim. However, the openings alternatively may be defined by recesses in one of those edges of the housing member, such that each recess is in part bordered by an edge of the backing plate or, on mounting of the light assembly, by the surface of the pool.

The openings may also be provided in the form of a circumferential array of slots extending axially from adjacent the rear edge of the housing member, arranged continuously around the periphery thereof, or alternatively arranged in a desired pattern around the periphery thereof.

The light assembly preferably is mountable on the wall surface of the pool by means of a mounting plate secured on the pool wall defining the surface. In one arrangement, the assembly is mountable by means of inter-connectable members on the mounting plate and the backing plate. When mounted on such mounting plate, the rear peripheral edge of the housing member may be adjacent a front face of the mounting plate. Alteratively, that rear edge may extend around the peripheral edge of the mounting plate.

The light assembly of the invention may be sued as part of a water extraction system for the pool. In such system, an extraction port member is provided in the pool wall at the location on that wall over which the light assembly is to be mounted. Water is able to be drawn from the pool via the port member, under the action of a pump or siphoning arrangement operable in a conduit extending outwardly, with respect to the pool, from the port member. Water is able to pass from the body of water in the pool, via the openings in the light assembly, and thereafter recycled to the pool. Water drawn from the pool may be circulated, for example, through heating means such as a solar heating installation and a filtration device. The recycled water may be recycled to the pool via a conventional inlet port member, or via a port member at a location over which a further light assembly is or is to be mounted.

Where, in such extraction system, the light assembly is mounted on a mounting plate, the extraction (or inlet) port member preferably is secured in an opening of the mounting plate. Also where such mounting plate is provided, the electric cable of the light assembly preferably extends through a gland provided in the mounting plate.

In such water extraction system, the total or aggregate area of the openings in the housing member may exceed the cross-sectional area of the extraction port member. It is preferred that the total area of the openings is in excess of 3.5 times, most preferably in excess of 4 times, the area of the extraction port member. Preferably the openings are not directly in line with the longitudinal extend of the extraction port member.

In order that the invention may more readily be understood, description now is directed to the accompanying drawings, in which.

Figure 1:
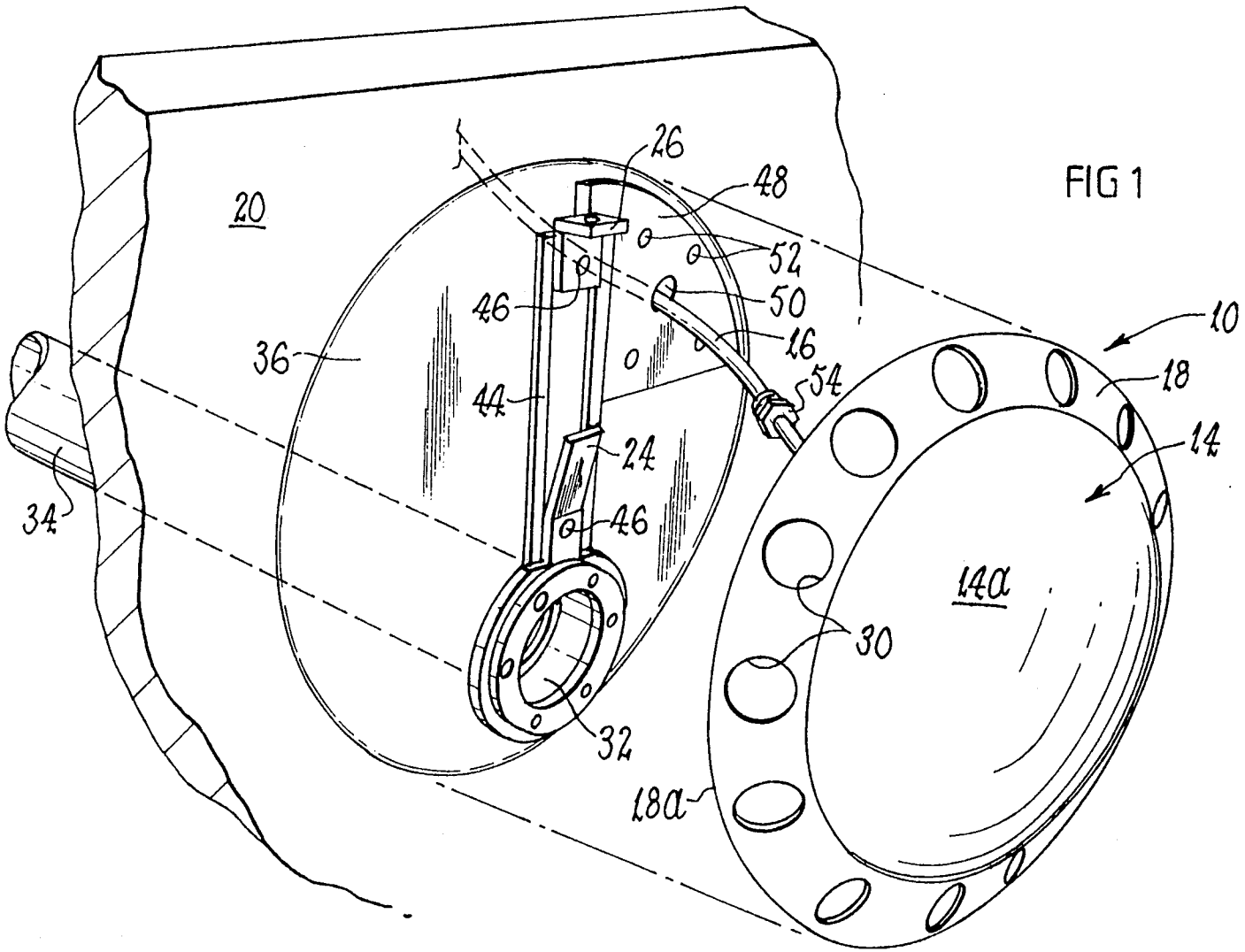
FIG. 1 is an exploded perspective view, showing a pool light assembly, forming part of an extraction system.
Figure 2:
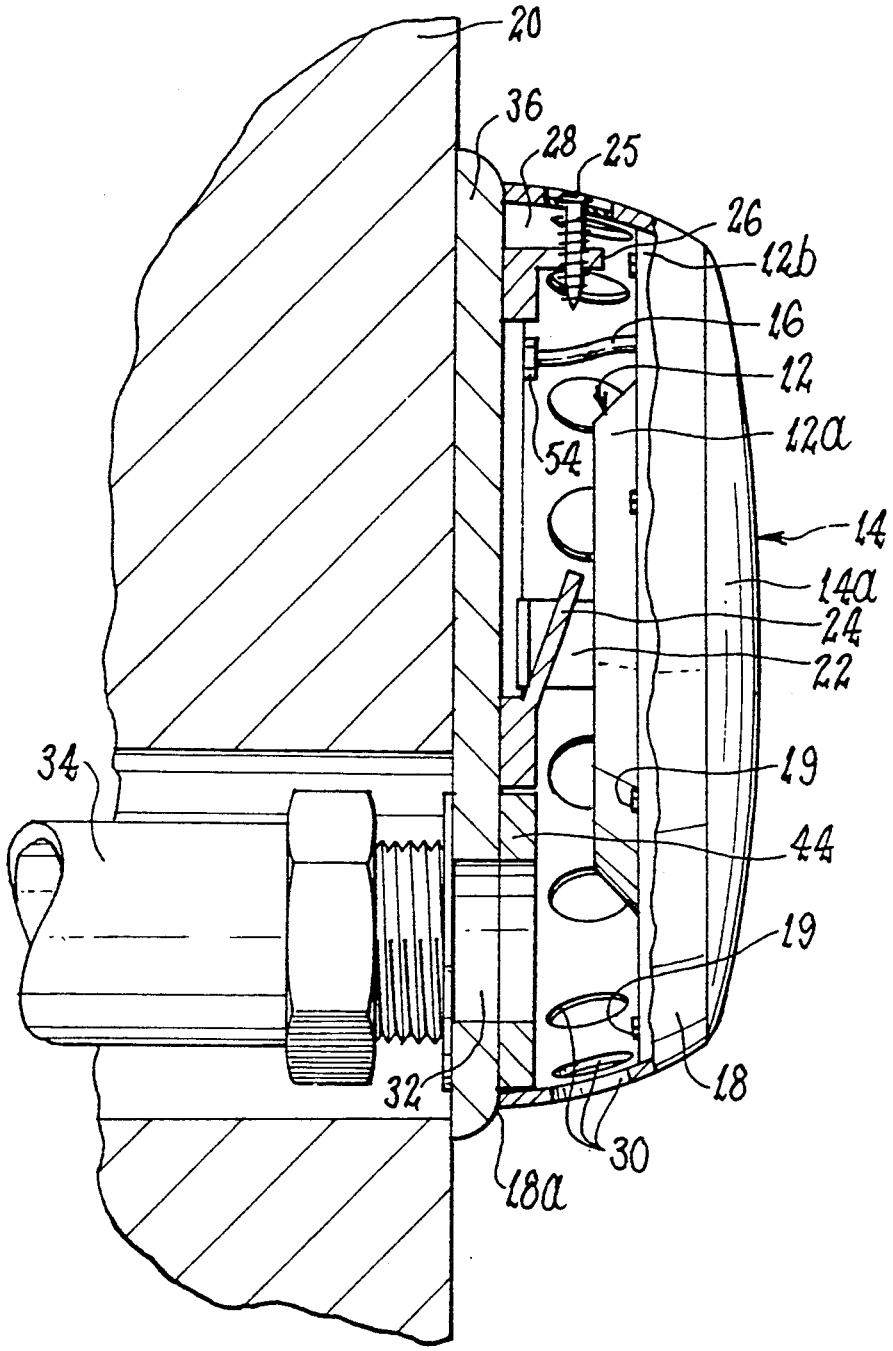
FIG. 2 is a partial, vertical sectional view of the assembly and system of FIG. 1.

As shown in FIGS. 1 and 2, light assembly 10 has a backing plate 12, to the front of which is secured a lens 14. Plate 12 is dished, to define an internally recessed central portion 12*a* around which a radially outwardly extending flange 12*b* extends. Lens 14 has a convex outer surface 14*a* and a correspondingly shaped concave internal surface opposed to portion 12*a* of plate 12. A somewhat lenticular chamber is defined between plate 12 and lens 14, in which is mounted an electrical connector with an electric lamp, such as a quartz halogen lamp, mounted in the connector. If required, a reflector is positioned behind the lamp to concentrate the light emitted through lens 14. An electric cable 16 passes from the lamp connector, sealingly through plate 12 such as via a sealing gland provided in plate 12, or between plate 12 and lens 14.

Plate 12 and lens 14 are held in assembly by means of an annular housing 18 extending around the peripheries thereof. In a typical arrangement, lens 14 has a diameter slightly in excess of the internal diameter of housing 18, such that a marginal portion of the latter overlies a marginal portion of the periphery of front surface 14*a* of lens 14. The rear surface of lens 14 is provided with a circumferential groove facing flange 12*b* of plate 12, with an O-ring seal being located in the groove. The outer diameter f flange 12*b* slightly exceeds that of lens 14, with circumferential spaced screws 19 outside the edge of lens 14 securing flange 12*b* to housing 18, to compress the O-ring seal between lens 14 and flange 12*b*, such that ingress of water into the chamber between plate 12 and lens 14 is precluded.

As shown in FIG. 2, housing 18 curves outwardly and rearwardly from the outer edges of plate 12 and lens 14. The arrangement is such that, with assembly 10 mounted on the surface of a peripheral wall 20 of a pool, the rear edge 18*a* of housing 18 is adjacent to wall 20. Mounting of assembly 10 on wall 20 in the arrangement illustrated is by means of a strap member 22, secured across the rear of plate 12, being received behind a locating tab 24 projecting outwardly from wall 20, and a screw 25 passing through housing 18 to engage in securing tab 26.

With assembly 10 mounted o wall 20, a compartment 28 is defined between plate 12, housing 18 and wall 20. With a body of water established in the pool bounded by wall 20, compartment 28 fills with water. In conventional arrangements, this occurs due to seepage past the rear edge 18*a* of housing 18 and, with time, the water in compartment 28 becomes stagnant. However, as shown, housing 18 is provided with a circumferential array of openings 30, such that water in the pool is able to circulate therethrough, obviating any risk of stagnant water being established in compartment 28.

Figure 3:
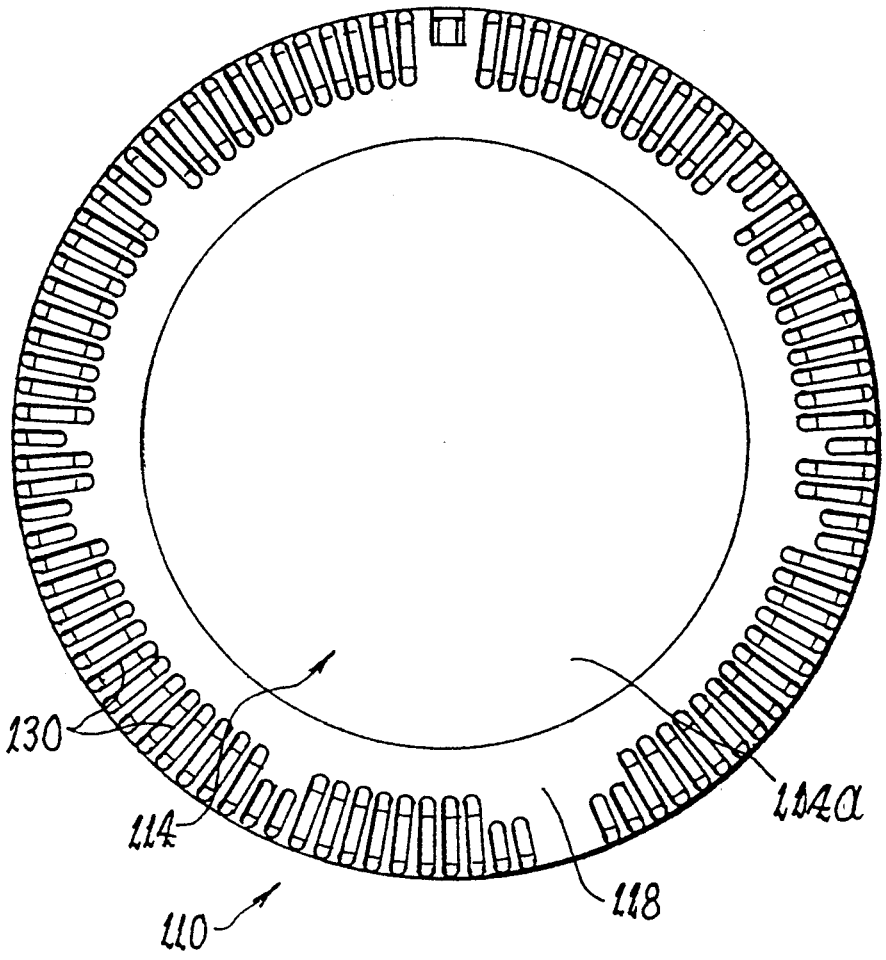
FIG. 3 is an elevation of an alternative form of the housing member of the assembly of FIGS. 1 and 2.

An alternative arrangement for the opening is illustrated in FIG. 3, where a light assembly 110 has a lens 114 and an annular housing 118 provided with openings 130. Openings 130 are in the form of a circumferential array of slots in two sizes, and arranged substantially continuously about the periphery thereof and adjacent to the rear edge thereof.

Returning to the embodiment illustrated in FIGS. 1 and 2, light assembly 10 as illustrated forms a cover for an extraction system, by which water in the pool can be drawn off for heating, or other purposes, prior to being recirculated to the pool. Thus, rearwardly of assembly 10, an extraction port 32 is provided in wall 20. Port 32 communicates with a conduit 34 which extends outwardly through wall 20, with conduit 34 forming part of a recalculation circuit including a pump or siphoning arrangement by which water can be extracted via port 32. The flow of water from the body thereof in the pool, to port 32, is facilitated by openings 30 in housing 18.

In the arrangement illustrated, port 32 is provided in a mounting plate 36 secured on wall 20 by suitable retaining screws passing through holes 40 (not shown) in plate 36. Also, as shown, tabs 24,26, by which light assembly 10 is mounted in relation to wall 20, project forwardly from plate 36.

The tabs 24,26 are provided on a strip member 44 which is secured to plate 36 by screws entered through holes 46. Member 44 is accurately positionable on plate 36 by fitting into a recessed side edge of quadrant plate 48 previously secured to plate 36. thereby aligning holes 46 with corresponding holes of plate 36. A shown, plate 48 has an opening 50 through which electric cable 16 passes from light assembly 10. Aligning opening 50 with a corresponding opening in plate 36 facilitates correct positioning of plate 48, and alignment of screw holes 52 of the latter with corresponding holes of plate 36. With plate 48 positioned and secured, correct positioning and seducement of member 44 is facilitated. This arrangement is particularly preferred where plate 36 is to be secured directly to wall 20 and then covered with a plastics lining for the pool, prior or positioning plate 48 and member 44.

As shown, a hollow nut 54, through which cable 16 passes, is threaded into opening 50 of plate. Preferably nut 54 tightens a gland seal through which cable 16 passes. In a preferred arrangement, plate 48 has a rearwardly extending cylindrical extension, co-axial with opening 50, in which an O-ring seal providing such gland seal is located. Such extension may project into the opening of plate 36 which corresponds to opening 50 of plate 48, while that opening of plate 36 may have a similar co-axial rearward extension in which the extension of plate 48 is received.

While housing 18 of light assembly 10 is shown as having circular openings 30, the openings may be of other forms, such as the slots illustrated in FIG. 3, or of any other shape. Also, instead of being spaced from the front and rear edges of the housing, openings may be provided at one or both of those edges such that the or each edge is of discontinuous or scalloped form. The total area of the openings 30 may be large relative to the cross-sectional area of port 32, such as at least equal to that area of port 32. The total area of openings may exceed the area of port 32 by a factor of at least about 1.5, but preferably exceeds that area by a factor of at least 3.5 and most preferably of at least 4.

While port 32 is referred to as an extractor port, it may alteratively be an inlet port for water recirculated to the pool. Alternatively, both an extractor and inlet arrangement can be used.

Finally, it is to be understood that various alterations, modifications and/or additions may be introduced into the constructions and arrangements of parts previously described without departing from the spirit or ambit of the invention.

I claim:

1. A below water light assembly for mounting on a wall surface of a pool, comprising:

a backing plate having an hole with a water-tight seal and interconnectable means;

a lens mounted to said backing plate defining a water-tight chamber;

mounting plate means for mounting to the wall surface, said mounting plate means containing interconnectable means for engagement with a backing plate interconnectable means;

an electric light source mounted within said chamber and being connected to an electric power source by an electric cable extending from said electric light source through said water-tight seal; and an annular housing member extending around and rearwardly from the periphery of said backing plate, the wall surface, housing member and backing plate defining a compartment, said annular housing member having a plurality of openings formed around its circumference such that water can circulate through said compartment.

2. The apparatus of claim 1 wherein said housing member extends rearwardly and outwardly from the periphery of said backing plate.

3. The apparatus of claim 1 wherein the openings in said annular housing member include at least two diametrically opposed holes or slots.

4. The apparatus of claim 1 wherein said openings are spaced form respective front and rear peripheral edges of the annular housing member such that each opening is defined by a respective continuous rim.

5. The apparatus of claim 1 wherein said openings are defined by recesses in a front peripheral edge of said annular housing member such that said recesses are in part bordered by an edge of said backing plate.

6. The apparatus of claim 1 wherein the openings are defined by recesses in a rear peripheral edge of the annular housing member such that said recesses are in part bordered by the wall surface.

7. The apparatus of claim 1 wherein said openings are a circumferential array of slots extending axially from adjacent a rear peripheral edge of said annular housing member.

8. The apparatus of claim 7 wherein said openings are arranged uniformly around the periphery of said annular housing member.

9. The apparatus of claim 1 wherein the rear peripheral edge of said annular housing member is adjacent a front face of said mounting plate.

10. The apparatus of claim 1 wherein the rear peripheral edge of said annular housing member extends around the peripheral edge of said mounting plate.

11. A water extraction system for a swimming pool or spa incorporated into a below water light assembly for mounting to a wall surface of the pool or spa comprising:

a backing plate having an hole with a water-tight seal and interconnectable means;

a lens mounted to said backing plate defining a water-tight chamber;

mounting plate means for mounting to the wall surface, said mounting plate means containing interconnectable means for engagement with a backing plate interconnectable means;

an electric light source mounted within said chamber and being connected to an electric power source by an electric cable extending from said electric light source through said water-tight seal;

an annular housing member extending around and rearwardly from the periphery of said backing plate, the wall surface, housing member and backing plate defining a compartment, said annular housing member having a plurality of openings formed around its circumference such that water can circulate through said compartment; and an inlet port in the wall surface proximate said mounting plate to draw water through said openings from the pool.

12. The apparatus of claim 11 wherein the light assembly operates as part of a water recalculation system for the pool, said water inlet port being located behind the light assembly on the wall surface whereby water can be recirculated to the pool via said openings in said annular housing member.

13. The apparatus of claim 12 further including an opening in said mounting plate through which said inlet port passes.

14. The apparatus of claim 12 further including a hole containing with a seal in said mounting plate through which said electric cable passes.

15. The apparatus of claim 12 wherein said openings have a total area which exceeds the cross-sectional area of said inlet port opening by a factor of at least 3.5.

16. The apparatus of claim 12 wherein said openings have a total area which exceeds the cross-sectional area of said inlet port opening by a factor of at least 4.0.

* * * * *

UNITED STATES PATENT AND TRADEMARK OFFICE

CERTIFICATE OF CORRECTION

PATENT NO. : 5,122,936

DATED : June 16, 1992

INVENTOR(S) : John H. Guthrie

It is certified that error appears in the above-identified patent and that said Letters Patent is hereby corrected as shown below:

In column 2, line 11, "Alteratively" should read --Alternatively--.

In column 2, line 13, "sued" should read --used--.

In column 2, line 44, "extend" should read --extent--.

In column 3, line 12, "f" should read --of--.

In column 3, line 55, "recalculation" should read --recirculation--.

In column 4, line 2, "A" should read --As--.

In column 4, line 9, "seducement" should read --securement--.

In column 4, line 12, "or" should read --to--.

In column 4, line 39, "alteratively" should read --alternatively--.

UNITED STATES PATENT AND TRADEMARK OFFICE

CERTIFICATE OF CORRECTION

PATENT NO. : 5,122,936

DATED : June 16, 1992

INVENTOR(S) : John H. Guthrie

It is certified that error appears in the above-indentified patent and that said Letters Patent is hereby corrected as shown below:

In column 5, line 8, "form" should read --from --.

In column 6, line 22, "recalculation" should read --recirculation --.

Signed and Sealed this

Twenty-sixth Day of July, 1994

Bruce Lehman

*Attest:*

BRUCE LEHMAN

*Attesting Officer*

*Commissioner of Patents and Trademarks*